US008375664B2

(12) United States Patent
Gower, Sr. et al.

(10) Patent No.: US 8,375,664 B2
(45) Date of Patent: Feb. 19, 2013

(54) FLOOD VENT

(75) Inventors: Larry Wayne Gower, Sr., Youngsville, NC (US); Larry Wayne Gower, Jr., Youngsville, NC (US)

(73) Assignee: AAA Louvers, Inc., Wendell, NC (US)

( * ) Notice: Subject to any disclaimer, the term of this patent is extended or adjusted under 35 U.S.C. 154(b) by 0 days.

(21) Appl. No.: 13/086,975

(22) Filed: Apr. 14, 2011

(65) Prior Publication Data

US 2012/0260593 A1 Oct. 18, 2012

(51) Int. Cl.
*E04B 1/70* (2006.01)
*E04F 17/00* (2006.01)
*E02D 19/00* (2006.01)

(52) U.S. Cl. ..... 52/302.1; 52/302.3; 52/169.5

(58) Field of Classification Search ..... 52/169.5, 52/302.1, 302.3, 1, 19, 473; 405/92, 96, 405/99–101
See application file for complete search history.

(56) References Cited

U.S. PATENT DOCUMENTS 5,944,445 A * 8/1999 Montgomery ..... 405/92
6,287,050 B1 * 9/2001 Montgomery et al. ..... 405/92
6,485,231 B2 * 11/2002 Montgomery et al. ..... 405/92
6,692,187 B2 * 2/2004 Sprengle et al. ..... 405/92
7,270,498 B1 9/2007 Albanese
7,600,944 B1 10/2009 Keating
2002/0021941 A1 * 2/2002 Montgomery et al. ..... 405/100
2003/0082008 A1 * 5/2003 Sprengle et al. ..... 405/87

OTHER PUBLICATIONS

Product brochure, Smart Vent Foundation Flood Vents, published prior to Jan. 12, 2011.

* cited by examiner

*Primary Examiner* — Mark Wendell
(74) *Attorney, Agent, or Firm* — Myers Bigel Sibley & Sajovec, P.A.

(57) ABSTRACT

A flood vent for mounting in a building structure subject to flooding includes a frame and a buoyant door. The frame has an external surface configured to be inserted into an opening in the building structure and has an upper wall and a lower wall longitudinally displaced from the upper wall and a pair of displaced sidewalls extending between the upper wall and lower wall on respective ends thereof. The buoyant door is pivotally mounted between the sidewalls proximate the upper wall of the frame. The door is mounted to be longitudinally movable a float distance between a first position and a second position, closer to the upper wall than the first position. When the door is in the first position it is not substantially rotatable and when the door is in the second position it is free to pivot.

19 Claims, 3 Drawing Sheets

FLOOD VENT

BACKGROUND OF THE INVENTION

The present invention relates to foundation vents for buildings and, more particularly, to flood vents and methods of operation of the same When a building foundation constructed by traditional methods is subjected to flooding, serious building damage can occur. Water is capable of doing permanent structural damage to a building, especially when the water contact occurs during a storm that will increase the force against the foundation walls. To help limit flooding damage, several building code organizations and the Federal government have promulgated regulations that mandate that buildings with enclosed spaces located below base flood plain levels, such as crawl spaces or other foundations, must provide for automatic equalization of interior and exterior hydrostatic forces caused by rising floodwaters.

According to these regulations, flooding fluids must be permitted to enter and exit the enclosed spaces freely. Such regulations often require builders to install a number of vents in the enclosed spaces. For example, Federal regulations promulgated by the Federal Emergency Management Agency (FEMA) require flood venting for the release of hydrostatic water pressure in new construction where the site has been designated as a flood-prone area.

SUMMARY OF THE INVENTION

Some embodiments of the present invention include a flood vent for mounting in a building structure subject to flooding. The flood vent includes a frame and a buoyant door. The frame has an external surface configured to be inserted into an opening in the building and has an upper wall and a lower wall longitudinally displaced from the upper wall and a pair of displaced sidewalls extending between the upper wall and lower wall on respective ends thereof. The buoyant door is pivotally mounted between the sidewalls proximate the upper wall of the frame. The door is mounted to be longitudinally movable a float distance between a first position and a second position, closer to the upper wall than the first position. When the door is in the first position it is not substantially rotatable and when the door is in the second position it is free to pivot.

In other embodiments, a rotation control track extends between the sidewalls in the lower wall that has a width and a length sized to receive a bottom end of the door therein and a depth less than the float distance. When the door is in the first position the track limits rotation thereof and when the door is in the second position the door is free to pivot.

In further embodiments, a pin is on each side of the door and an L-shaped slot is in each of the sidewalls. Each of the L-shaped slots has a first leg extending from a back face of the frame to a middle region of the frame and a second leg extending longitudinally from the first leg towards the lower wall. Each of the pins is received within the second leg of a corresponding one of the L-shaped slots to mount the door pivotally and longitudinally movably within the frame.

In other embodiments, when rotated to an insertion orientation, the door is further movable to a third position, closer to the upper wall than the second position. In the third position, the pins are aligned with the first legs of their corresponding one of the L-shaped slots to allow the door to be separated from the frame by movement of the pins through the second legs and out the back face of the frame.

In further embodiments, the door includes a buoyant panel member. A first protective panel member that is harder than the buoyant panel member is mounted to a front face of the buoyant panel member. A second protective panel member that is harder than the buoyant panel member is mounted to a back face of the buoyant panel member. The buoyant panel member may be Styrofoam and the first and second protective panel members may be polyvinylchloride (PVC). The first and second protective panel members may be coupled to the buoyant panel member by an adhesive.

In other embodiments, the door is pivotally movable from a middle orientation aligned with the rotation control track towards both a back face and a front face of the frame when the door is in the second position to allow water to flow therethrough in either direction. In the middle orientation, the door may be contained entirely within the frame. The rotation control track may be a recessed channel in the lower wall and the depth of the rotation control track may be no more than about 0.125 inches. The rotation control track may be a channel mounted on an upper face of the lower wall. An upper face of the door may be chamfered along front and back edges to limit interference of the upper wall with rotation of thereof. The door may be pivotally mounted in the frame at a lateral height allowing objects up to four inches in size to pass unobstructed through the vent when the door is in the second position. The rotation control track may be the only limitation on rotation of the door in the vent.

In further embodiments, the external surface of the frame is configured to be mounted in a foundation of the building structure with the lower wall thereof positioned below the upper wall thereof when mounted in the foundation. A pin may be removably mounted on each side of the door, each of which is received in a corresponding slot on an adjacent one of the sidewalls to mount the door pivotally and longitudinally movably within the frame. The door may include at least one vent opening extending through the door from a front face of the frame to a back face of the frame.

In yet other embodiments, the door includes a buoyant panel member. A first protective panel member that is harder than the buoyant panel member is mounted to a front face of the buoyant panel member. A second protective panel member that is harder than the buoyant panel member is mounted to a back face of the buoyant panel member. A screen is mounted between the buoyant panel member and one of the protective panel members. The at least one vent opening extends through all the panel members and the screen extends across the at least one vent opening.

DETAILED DESCRIPTION OF EMBODIMENTS OF THE INVENTION

Figure 2:
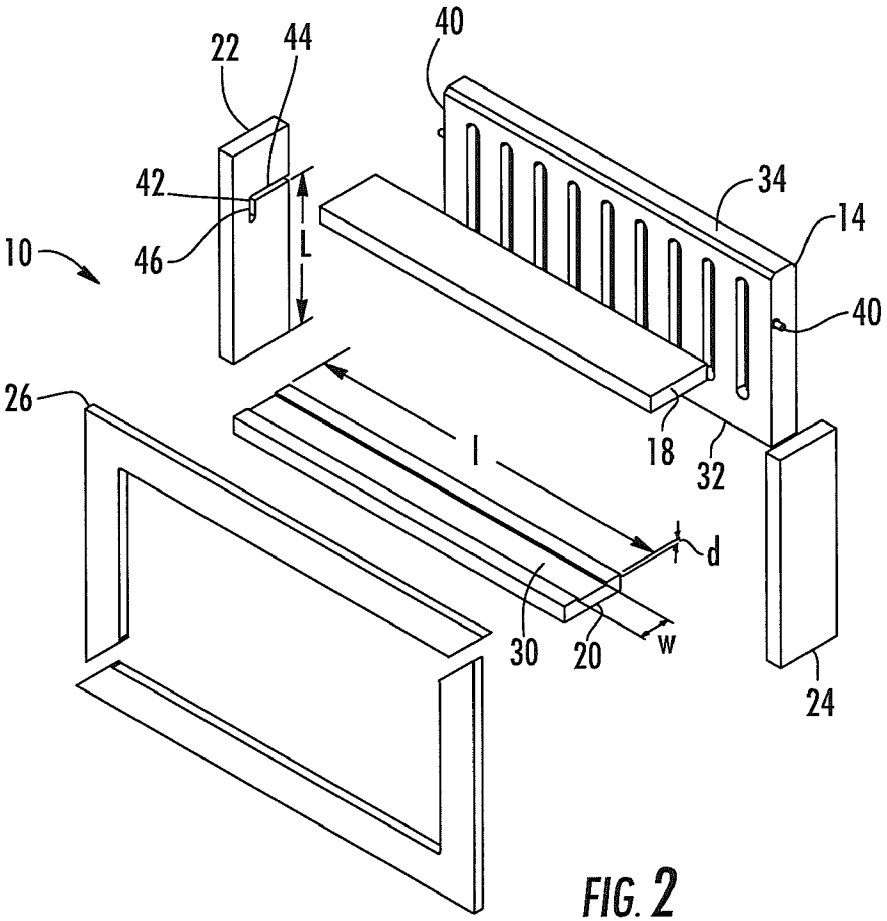
FIG. 2 is an exploded perspective view of the vent of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will be described herein, some embodiments of the present invention provide a flood vent to be used in foundations, exterior walls and/or garage doors of building structures to equalize water pressure inside and outside of the building structure. As water rises and comes in contact with the vent door, the vent door will float longitudinally up out of a track in the vent frame and pivot to allow water to flow in and out through the vent freely. Some embodiments provide an affordable vent manufactured from material that need not corrode, rot, warp or rust, such as polyvinylchloride (PVC) and Styrofoam and can be painted to match color patterns desired for the building structure where they will be installed by contractors, homeowners and the like. By providing a vent as described herein, when water rises to the height of the door, the door, made from the floatable polymer material, will be able to float up out of a track that otherwise would restrain its rotational movement in the bottom of the frame and pivot, floating on top of the water until it reaches a horizontal position of maximum flow clearance. As such, hydrostatic pressure may be effectively equalized in an enclosed area, such as a crawlspace, to reduce the risk of damage to the structure under flood conditions. The vent may be particularly beneficial in that it is of a configuration unlikely to become clogged with debris, which would limit its functionality. The simple design of the product and limited number of parts further decreases the risk of mechanical failures or the like affecting the performance of the flood vent.

As will be also further described herein, in some embodiments, the flood vent is provided as a frame with a door, which door may be vented or non-vented, inside the frame and secured inside the frame by two pins mounted on the door that are fitted into a corresponding slot on the sides of the frame. The door in a rest position, without flooding, rests in a track on the bottom wall of the frame. In some embodiments, when water reaches the bottom of the door, the door floats up, for example, $1/8^{th}$ of an inch out of the track and pivots as water rises and the door floats on top of the water, allowing water and debris up to, in some embodiments, four inches in diameter, to flow unobstructed.

As such, in some embodiment of the present invention a flood vent may be provided that includes only three components, a frame, a door and pivot pins. Such may be manufactured, for example, from cellular PVC and Styrofoam. Such materials will generally not corrode, rust, rot or warp. The frame might also be made from any other suitable material. The door may also be made of PVC and Styrofoam and be selectively made very buoyant based on a ratio of those materials or from other materials that will provide flotation to the door itself.

Figure 1:
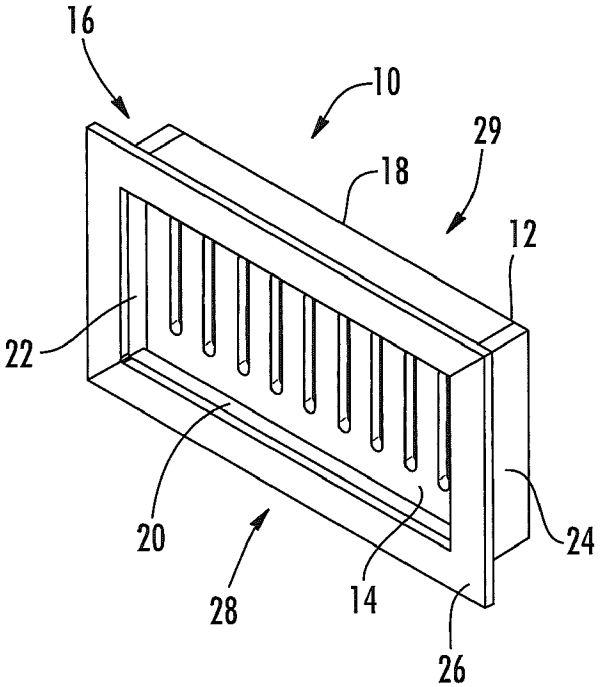
FIG. 1 is a perspective view of a vent according to some embodiments of the present invention.
Figure 3:
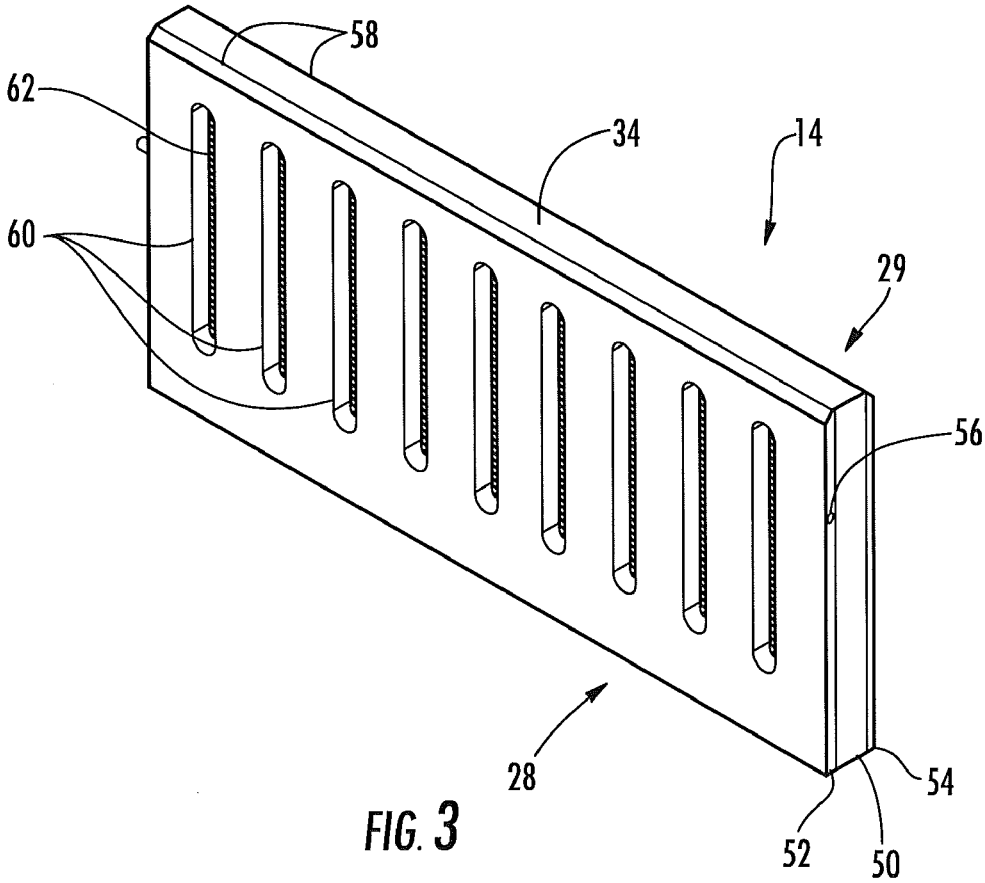
FIG. 3 is a perspective view of the door of the vent of FIG. 1.
Figure 4A:
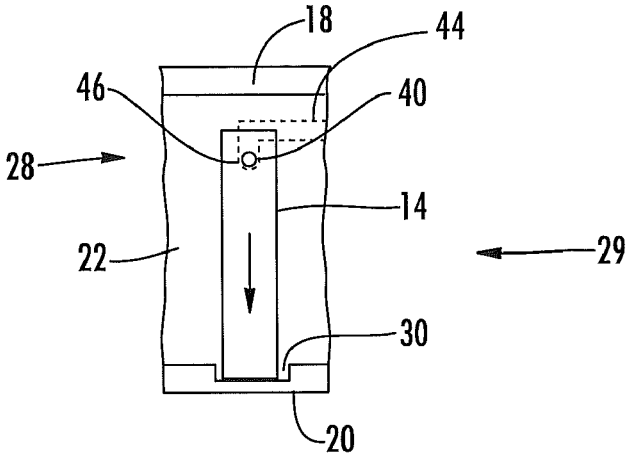
FIGS. 4A-4C are cross-sectional side views of the vent in three different positions according to some embodiments of the present invention.
Figure 4B:
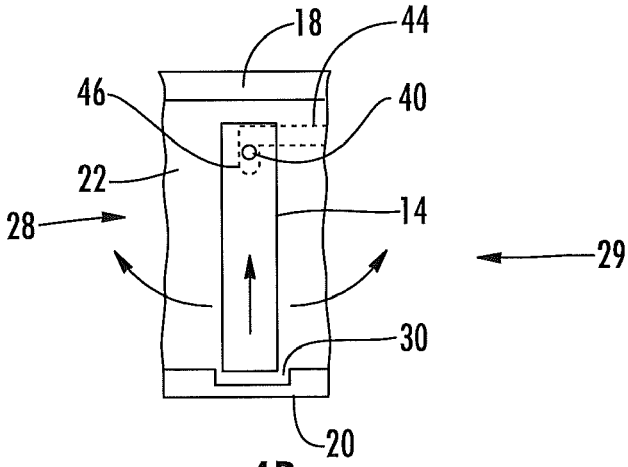
Figure 4C:
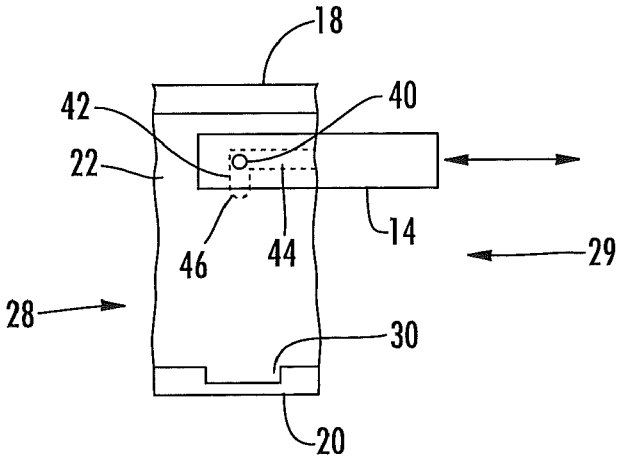

Embodiments of the present invention will now be further described with reference to FIGS. 1-3 and 4A to 4C. FIG. 1 is a perspective view of a flood vent 10 according to some embodiments of the present invention. FIG. 2 is an exploded perspective view of the flood vent of FIG. 1. FIG. 3 is a perspective view of the buoyant door 14 of the flood vent of FIG. 1. FIGS. 4A-4C are sectional side-views of the flood vent of FIG. 1 shown with the buoyant door 14 in three lateral positions thereof.

As seen in FIG. 1, a flood vent 10 for mounting in a building structure subject to flooding according to some embodiments of the present invention includes a frame 12 and a buoyant door 14. The frame 12 has an external surface 16 configured to be inserted into an opening in the building structure. The frame further includes a longitudinally displaced upper wall 18 and lower wall 20 with a pair of sidewalls 22, 24 displaced from each other and extending between the upper wall 18 and the lower wall 20.

In describing the flood vent 10 herein, reference will be made to a front face 28 and a back face 29 of the frame 12 and buoyant door 14. These references are used from the perspective of an expected orientation of the flood vent 10 when inserted into an opening in a building structure. For example, in use in a foundation application, the rear/back face 29 will be within the crawlspace of the building structure while the front face 28 will be on the external visible end of the opening in the building structure.

As further seen in FIG. 1 and FIG. 2, in some embodiments, a decorative front plate 26 is provided, which may be used to improve the appearance of the flood vent 10 from external to the building structure when the flood vent 10 is inserted into an opening in the building structure.

The buoyant door 14 is pivotally mounted between the sidewalls 22, 24 proximate the upper wall 18 of the frame 12. Note that the location proximate the upper wall 18 is displaced therefrom to allow both lateral flotation movement of the buoyant door 14 and rotation of the buoyant door 14 when it is in the position where it is free to rotate, without interference with the frame 12. A such, the buoyant door 14 is also mounted to be longitudinally moveable (see access reference L in FIG. 2) between a first position and a second position closer to the upper wall than the first position. The first position referenced herein is seen in the sectional side view of FIG. 4A, wherein the buoyant door 14 is in a longitudinally lowest position in contact with the lower wall 20. The second position is illustrated in FIG. 4B. As seen in FIGS. 4A and 4B, when the buoyant door 14 is in the first position (FIG. 4A) it is not substantially rotatable and when the buoyant door 14 is in the second position (FIG. 4B) it is free to pivot.

In the particular embodiments shown in FIGS. 1 and 2, a rotation control track 30 is found in the lower wall 20. The rotation control track 30 extends between the sidewalls 22, 24 for a length e. The length e is sized to receive a bottom end 32 of the buoyant door 14 therein. The rotation control track 30 further has a width w and a depth d. The depth d is less than a float distance, which corresponds to the lateral location difference of the door between FIG. 4A and FIG. 4B positions (i.e., the buoyant door 14 is longitudinally moveable a float distance between the first position of FIG. 4A and the second position of FIG. 4B). As such, when the buoyant door 14 floats up the float distance it is removed from the rotation control track 30 so as to be free to pivotally rotate in both directions, inward and outward, as seen in FIG. 4B.

As also seen in FIG. 2, in some embodiments of the present invention, a pin 40 is provided on each side of the buoyant door 14. The pin 40 may be removeably mounted on each side of the buoyant door 14, for example, in a hole 56 as seen in FIG. 3.

An L-shaped slot 42 in each of the sidewalls 22, 24 is provided to receive a corresponding adjacent one of the pins 40. Each of the L-shaped slots 42 has a first leg 44 extending from the back face 29 of the frame 12 to a middle region of the frame, and a second leg 46 extending from the first leg 44 towards the lower wall 20. Each of the pins 40 is received within the second leg of a corresponding one of the L-shaped slots 42 to mount the buoyant door 14 both pivotally and longitudinally moveably within the frame 12.

As seen in FIG. 4C, when rotated to an insertion orientation as shown in FIG. 4C, with the buoyant door 14 a substantially horizontal orientation, the buoyant door 14 is further moveable to the third position seen in FIG. 4C, closer to the upper wall 18 than the second position of FIG. 4B, in which the pins 40 are aligned with the first legs 44 of their corresponding one of the L-shaped slots 42. In this position the buoyant door 14 is allowed to be separated from the frame 12 by movement of the pins 40 through the first legs 44 and out the back face 29 of the frame 12.

Further aspects of the buoyant door 14 according to some embodiments of the present invention will now be described with reference to the perspective view of FIG. 3. In the embodiments illustrated in FIG. 3, the buoyant door 14 includes a central buoyant panel member 50 and a first protective panel member 52 that is harder than the buoyant panel member 50 and is mounted to a front face 28 of the buoyant panel member 50. A second protective panel member 54, that is also harder than the buoyant panel member 50, is mounted to a back face 29 of the buoyant panel member 50. In some embodiments, the buoyant panel member 50 is Styrofoam and the first and second protective panel members 52, 54 are polyvinylchloride (PVC). The first and second protective panel members 52, 54 may be coupled to the buoyant panel member 50, for example, by an adhesive.

In the embodiment seen in FIG. 3, the buoyant door 14 further includes a plurality of vent openings 60 extending through the buoyant door 14 from the front face 28 to the back face 29. A screen 62 that is mounted between the buoyant panel member 50 and one of the protective panel members 52, 54 is also seen in the embodiments of FIG. 3. The vent openings 60 extend through all the panel members 50, 52, 54 and the screen 62 extends across the vent openings 60. As also seen in the embodiments of FIG. 3, the upper face 34 of the door is chamfered along front and back edges 58 of the upper face 34, which may limit interference of the upper wall 18 with rotation of the buoyant door 14.

As seen with reference to FIGS. 2 and 4B, the buoyant door 14 may be pivotally mounted in the frame 12 at a lateral height L allowing objects up to four inches in size to pass unobstructed through the vent once the door has floated to the second position of FIG. 4B and is free to rotate to a horizontal position floating on the top of the flood waters or the like. In illustrated embodiments, the buoyant door 14, as seen by the arrows in FIG. 4B, is pivotally moveable from a middle orientation aligned with the rotation control track 30 both towards a back face 29 and a front face 28 of the frame 12 when the buoyant door 14 is in the second position of FIG. 4B to allow water to flow there through in either direction.

In some embodiments, in the middle orientation as seen in the rest position of the buoyant door 14 shown in FIGS. 4A and 4B, the buoyant door 14 is contained entirely within the frame 12. The rotation control track 30 may be a recessed channel in the lower wall 20 and the depth d of the rotation control track 30 may be, for example no more than about 0.125 inches. The float distance for movement between the first and second positions of FIGS. 4A and 4B may then be at least above 0.125 inches. It will be understood, however that rather than being a recessed channel, the rotation control track 30 in other embodiments is a channel mounted on an upper face of the lower wall 20. The rotation control track 30 may, in some embodiments, be the only limitation on the rotation of the buoyant door 14 in the flood vent 10.

The external surface 16 of the frame 12 may be configured to be mounted in a foundation of a building structure with the lower wall 20 thereof positioned below the upper wall 18 thereof when mounted in the foundation. In other words, gravity should drop the buoyant door 14 into the track 30 when it is not lifted and subject to flood waters making it buoyantly rise longitudinally from the FIG. 4A position to the FIG. 4B position.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed:

1. A flood vent for mounting in a building structure subject to flooding, comprising:

a frame having an external surface configured to be inserted into an opening in the building structure and having an upper wall and a lower wall longitudinally displaced from the upper wall and a pair of displaced sidewalls extending between the upper wall and lower wall on respective ends thereof; and a buoyant door pivotally mounted between the sidewalls proximate the upper wall of the frame, the door further being mounted to be longitudinally movable a float distance between a first position and a second position, closer to the upper wall than the first position, wherein when the door is in the first position it is not substantially rotatable and when the door is in the second position it is free to pivot, wherein the door pivots within the frame about a rotation axis where the door is mounted to the frame and wherein the rotation axis is longitudinally moved closer to the upper wall when the door is longitudinally moved from the first position to the second position.

2. The vent of claim 1, further comprising a rotation control track extending between the sidewalls in the lower wall and having a width and a length sized to receive a bottom end of the door therein and a depth less than the float distance, wherein when the door is in the first position the track limits rotation thereof and when the door is in the second position the door is free to pivot.

3. The vent of claim 2, further comprising a pin on each side of the door and an L-shaped slot in each of the sidewalls, each of the L-shaped slots having a first leg extending from a back face of the frame to a middle region of the frame and a second leg extending longitudinally from the first leg towards the lower wall, wherein each of the pins is received within the second leg of a corresponding one of the L-shaped slots to mount the door pivotally and longitudinally movably within the frame.

4. The vent of claim 3, wherein, when rotated to an insertion orientation, the door is further movable to a third position, closer, to the upper wall than the second position, in which the pins are aligned with the first legs of their corresponding one of the L-shaped slots to allow the door to be separated from the frame by movement of the pins through the second legs and out the back face of the frame.

5. The vent of claim 2, wherein the door comprises:

a buoyant panel member;

a first protective panel member that is harder than the buoyant panel member that is mounted to a front face of the buoyant panel member; and a second protective panel member that is harder than the buoyant panel member that is mounted to a back face of the buoyant panel member.

6. The vent of claim 5, wherein the buoyant panel member comprises Styrofoam and the first and second protective panel members comprise polyvinylchloride (PVC) and wherein the first and second protective panel members are coupled to the buoyant panel member by an adhesive.

7. The vent of claim 2, wherein the door is pivotally movable from a middle orientation aligned with the rotation control track towards both a back face and a front face of the frame when the door is in the second position to allow water to flow therethrough in either direction.

8. The vent of claim 7, wherein, in the middle orientation, the door is contained entirely within the frame.

9. The vent of claim 2, wherein the rotation control track comprises a recessed channel in the lower wall and the depth of the rotation control track is no more than 0.125 inches.

10. The vent of claim 2, wherein an upper face of the door is chamfered along front and back edges to limit interference of the upper wall with rotation of the door.

11. The vent of claim 2, wherein the door is pivotally mounted in the frame at a longitudinal height allowing objects up to four inches in size to pass unobstructed through the vent when the door is in the second position.

12. The vent of claim 2, wherein the rotation control track comprises a channel mounted on an upper face of the lower wall and the depth of the rotation control track is no more than 0.125 inches.

13. The vent of claim 2, wherein the rotation control track is the only limitation on rotation of the door in the vent.

14. The vent of claim 2, wherein the external surface of the frame is configured to be mounted in a foundation of the building structure with the lower wall thereof positioned below the upper wall thereof when mounted in the foundation.

15. The vent of claim 2, further comprising a pin removably mounted on each side of the door, each of which is received in a corresponding slot on an adjacent one of the sidewalls to mount the door pivotally and longitudinally movably within the frame.

16. The vent of claim 2, further comprising at least one vent opening extending through the door from a front face of the frame to a back face of the frame, wherein the door comprises:

a buoyant panel member;

a first protective panel member that is harder than the buoyant panel member that is mounted to a front face of the buoyant panel member;

a second protective panel member that is harder than the buoyant panel member that is mounted to a back face of the buoyant panel member; and a screen that is mounted between the buoyant panel member and one of the protective panel members, wherein the at least one vent opening extends through all the panel members and the screen extends across the at least one vent opening.

17. The vent of claim 16, wherein the buoyant panel member comprises Styrofoam and the first and second protective panel members comprise polyvinylchloride (PVC) and wherein the first and second protective panel members are coupled to the buoyant panel member by an adhesive.

18. The vent of claim 1, wherein movement of the door from the first position to the second position releases the door to allow pivotal movement thereof.

19. The vent of claim 2, wherein a distance between the bottom end of the door and a top end of the door proximate the upper wall of the frame is the same in the first position and the second position.

* * * * *

UNITED STATES PATENT AND TRADEMARK OFFICE

CERTIFICATE OF CORRECTION

PATENT NO. : 8,375,664 B2
APPLICATION NO. : 13/086975
DATED : February 19, 2013
INVENTOR(S) : Gower, Sr. et al.

It is certified that error appears in the above-identified patent and that said Letters Patent is hereby corrected as shown below:

In the Specifications:

Column 5, Line 23:

Replace "for a length e. The length e is sized to receive"

to read -- for a length $\ell$. The length $\ell$ is sized to receive --

Signed and Sealed this
Thirtieth Day of April, 2013

Teresa Stanek Rea
*Acting Director of the United States Patent and Trademark Office*